United States Patent [19]

Macho

[11] 4,378,819

[45] Apr. 5, 1983

[54] DETACHABLE CONNECTION ARRANGEMENT FOR A SHED FORMING DEVICE OF A LOOM

[75] Inventor: Helmut Macho, Constance, Fed. Rep. of Germany

[73] Assignee: Aktiengesellschaft Adolph Saurer, Arbon, Switzerland

[21] Appl. No.: 184,939

[22] Filed: Sep. 8, 1980

[30] Foreign Application Priority Data

Sep. 26, 1979 [CH] Switzerland ..... 8670/79

[51] Int. Cl.[3] ..... D03C 9/06

[52] U.S. Cl. ..... 139/88; 403/328

[58] Field of Search ..... 139/57, 58, 82, 84, 139/88; 403/328 R

[56] References Cited

U.S. PATENT DOCUMENTS

| | | | |
|---|---|---|---|
| 1,618,851 | 2/1927 | Thunberg et al. | 403/328 |
| 3,696,842 | 10/1972 | Pfarrwaller | 139/57 |
| 4,085,856 | 4/1978 | Westendorf | 403/328 |

FOREIGN PATENT DOCUMENTS

| | | | |
|---|---|---|---|
| 2201812 | 6/1973 | Fed. Rep. of Germany | 139/82 |
| 2813169 | 3/1980 | Fed. Rep. of Germany . | |
| 2311873 | 1/1977 | France | 139/88 |
| 2406672 | 7/1979 | France | 139/57 |

*Primary Examiner*—Henry Jaudon

*Attorney, Agent, or Firm*—Werner W. Kleeman

[57] ABSTRACT

A detachable connection arrangement is disclosed which comprises a lifter element of a harness lever arrangement wherein at the free end of the lifter element a quadratic or square connection block is rotatable upon a pin or journal and is detachably inserted into a substantially C-shaped claw member at the loom harness. Pin members which are resiliently supported in the claw member engage into recesses at counter surfaces of the connection block and thus form a snap closure. These measures provide a connection arrangement which satisfies all of the requirements placed thereon, especially as concerns simple fabrication thereof, easy connection or release and complete force transmission practically free of wear.

7 Claims, 2 Drawing Figures

DETACHABLE CONNECTION ARRANGEMENT FOR A SHED FORMING DEVICE OF A LOOM

BACKGROUND OF THE INVENTION

The present invention relates to a new and improved construction of a detachable connection arrangement between a loom harness and a harness lever arrangement of a shed forming device or apparatus of a loom.

Generally speaking, the connection arrangement of the present development is of the type comprising a substantially vertical lifter or lifter element which is hingedly connected with the harness lever arrangement, this lifter carrying at its end, at the region of the loom harness, a coupling element which engages in a form-locking fashion in a counter coupling element provided at the loom harness.

The movement between the shed forming apparatus and the loom harnesses is transmitted by a harness lever arrangement having a series of levers and hingedly connected force transmission rods. At least at the connection location between the last force transmission rod, the so-called lifter and the loom harness, there should be possible a disconnection, in order to ensure for a rational exchange of the harnesses, for instance when inserting a new warp.

For this purpose there have already become known to the art different constructions wherein the lifters are formed of two bifurcated arranged sheet metal bands which are connected on the one hand, with a force transmission rod and, on the other hand, by means of a pivot bolt with the harness frame.

According to French Pat. No. 1,127,685, the sheet metal bands are resiliently constructed. One band carries the bolt which then penetrates through both the harness frames as well as also the other band. By spreading apart both of the bands, it is possible to accomplish the release or disconnection.

It should be readily perceivable that such arrangement is only capable of transmitting to a limited degree forces in a uniform fashion and that such arrangement is subjected to a great amount of wear.

Now in order to counteract this wear with the previously described, rapidly releasable arrangement, it has been proposed according to German Pat. No. 2,131,671 that both of the sheet metal bands which form the lifters not be resiliently constructed. In such case, one band is fixedly arranged at an element of the harness lever arrangement and carries a bolt which is mounted in a bore of the harness frame. This bolt possesses a central hole into which engages a further pin at the other band or tape. This thus assembled structure is then connected by means of releasable clamping elements.

This arrangement is capable of transmitting forces relatively free of wear, but however is extremely complicated and cumbersome to release.

According to another embodiment as disclosed in German Pat. No. 2,609,964, the vertical lifter consists of a square or four-cornered tube with internally arranged tooth profile into which engages a coupling element at the loom harness having a counter tooth profile.

With this arrangement the release of the connection appears to be simple, but however the recoupling of the loom harness and the lifter is not readily possible, since it is first necessary to introduce the coupling element at the loom harness into a portion of the tube of the lifter which is free of the internal tooth profile. Additionally, further safeguards must be provided in order to prevent any unintentional decoupling.

SUMMARY OF THE INVENTION

Therefore, with the foregoing in mind, it is a primary object of the present invention to provide a new and improved construction of a detachable connection arrangement for a shed forming device of a loom which is not associated with the aforementioned drawbacks and limitations of the prior art constructions.

Another and more specific object of the present invention aims at providing a new and improved construction of a detachable connection arrangement of the previously mentioned type which, while avoiding the aforementioned drawbacks, enables through the use of simple means a rapid and positive establishment of the connection and release of the connection between a loom harness and the harness lever arrangement.

Now in order to implement these and still further objects of the invention, which will become more readily apparent as the description proceeds, the detachable or releasable connection arrangement of the present development is manifested by the features that the coupling element comprises a connection block having at least two parallel surfaces and which connection block is supported at the lifter or lifter element by means of a pin or journal. The counter coupling element comprises a substantially C-shaped claw member which is fixedly connected with the loom harness. The inner leg surfaces of the claw member constitute support surfaces for the connection block, and in the claw member resiliently supported spherical or ball bodies or pins form a snap closure which is effective in the force direction and retains the connection block in the claw member.

Due to these measures, there now exist the possibility of rapidly establishing a positive connection by merely laterally pressing in the connection block carried by the lifter into the claw until latching of the snap closure. In equally rapid fashion it is possible to disconnect these components by simply inserting and tilting a suitable tool, for instance a screw driver, between the connection block and a web of the C-shaped claw member, so that both elements again disconnect. Through the provision of large support surfaces at the connection block and claw member, there is additionally realized the complete transmission of the forces.

According to a preferred embodiment, the connection block can possess a quadratic or square cross-sectional shape, at least at its plane of movement and can be quickly inserted into the claw member.

These measures prevent any one-sided wear, particularly then when the connection block is inserted with a certain play into the claw member, in order to be able to obtain an additional oscillation dampening action due to cushioning of the connection block by means of the spring of the snap closure.

A further design according to the invention can reside in the features that the bore within the connection block is arranged eccentrically and asymmetrically for the purpose of receiving the pin or journal of the lifter element.

This measure enables, depending upon the sudden change of the connection block in the lifter element, compensating elevational differences between the connection block and the claw member or undertaking an adjustment of the harness for accommodation to the fabric or cloth being woven.

A preferred embodiment furthermore resides in the fact that the upper support surface at the C-shaped claw member comprises an extended or protecting portion which extends past the lower support surface and past the connection block.

This enables a further simplification during establishing the connection or releasing the connection, in that it is possible to freely place the harness frame upon the connection block or blocks, as the case may be, and then to insert and latch the connection blocks in the claw members and vice versa.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
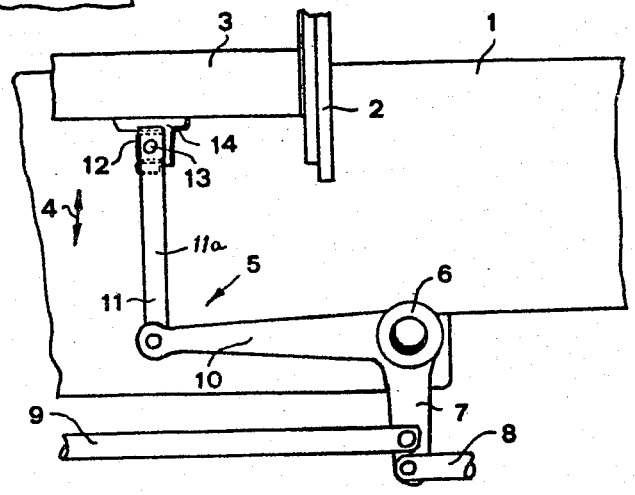
FIG. 1 is a schematic illustration, partially in sectional view, of a harness lever arrangement at a loom equipped with a loom harness.

Describing now the drawings, according to the showing of FIG. 1 there is mounted at a loom, which has only been conveniently represented by a machine frame section 1, the so-called harness guide 2 in which, in known manner, a loom harness 3 is guided for a vertical up-and-down movement in the direction of the double-headed arrow 4 of FIG. 1. In the illustration there has only been shown one side of the loom. Of course, at the opposite side of the loom there is provided a similar or counter guide arrangement.

The movement of the harness 3 is undertaken by means of a harness lever arrangement 5 of a not further illustrated standard shed forming device or apparatus. The harness lever arrangement 5 comprises an angle lever 6 which is hingedly connected at a thrust arm 7 with the main connection rod 8 leading to the not particularly illustrated drive and is also hingedly connected with a connection rod 9 at the not particularly illustrated angle lever located at the other side of the loom. At the free end of the other arm 10 of the angle lever 6 this angle lever 6 is hingedly connected with the one end of a lifter or lifter element 11, formed of two essentially parallel brackets, generally indicated by reference character 11*a*. At the other end of the lifter or lifter element 11, there is rotatably retained between both brackets 11*a* a connection block 12 by means of a bolt 13 or equivalent structure. This connection block or element 12 is inserted into a substantially C-shaped claw member 14. This claw member 14 is fixedly mounted at the underside of the loom harness 3. The connection block 12 thus forms together with the claw member 14 a releasable connection arrangement which will be described more fully hereinafter in conjunction with FIGS. 2 and 3.

Figure 2:
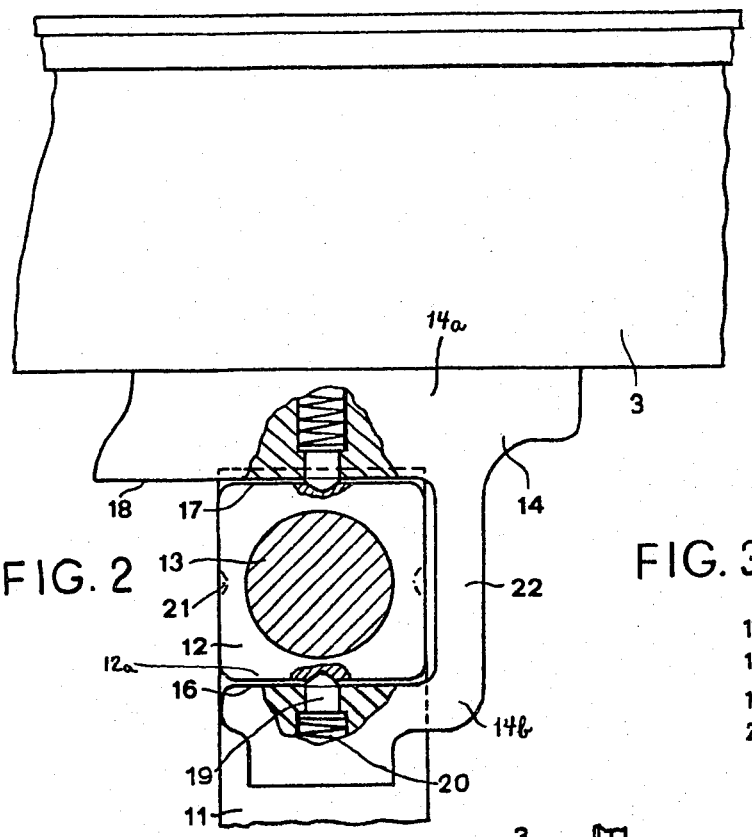
FIG. 2 illustrates on an enlarged scale details of the detachable connection arrangement between the loom harness and the harness lever arrangement of FIG. 1.
Figure 3:
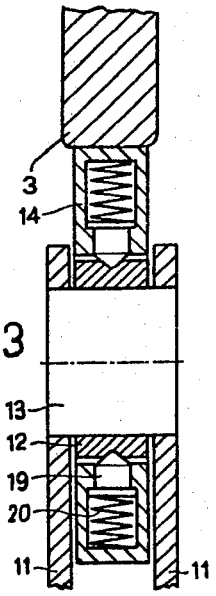
FIG. 3 is a sectional detail of the arrangement of FIG. 2.

From the illustration of FIGS. 2 and 3 there will be seen details of the inventive releasable or detachable connection arrangement between the harness frame 3 and the lifter or lifter element 11 of the harness lever arrangement 5. In this case, the brackets 11*a* of the lifter 11 have only been partially shown in the illustration of FIGS. 2 and 3 in order to preserve clarity in the showing of the drawings and to simplify the illustration. But these brackets 11*a* are represented in greater detail in FIG. 1, however, as explained above.

According to the showing of FIGS. 2 and 3, the connection block 12 possesses in its plane of movement, represented in FIG. 1, by the double-headed arrow 4, a square or quadratic cross-sectional configuration. This enables the connection block 12 to be selectively differently rotated about the bolt or pin 13 and inserted into the claw member 14.

It is here mentioned that the mounting or bearing bore 15 in the connection block 12, through which there is inserted the journal or bolt 13 of the lifter 11, also can be arranged off-center or eccentrically and asymmetrically, which with corresponding reverse insertion of the connection block 12 into the claw member 14 enables regulating the relative harness height, and thus the fabric or cloth which is being processed.

The C-shaped claw member 14 which is fixedly arranged at the harness 3 possesses an inner width between the parallel support surfaces 16 and 17 which corresponds to the dimensions of the connection block 12. The upper support surface 17 possesses an extended portion or overhang 18 which enables mounting of the harness 3 at the connection block 12 prior to the relative insertion of the connection block 12 into the claw member 14 and vice versa. This facilitates, as should be readily apparent, establishing and releasing the connection.

In both of the leg portions of members 14*a* and 14*b* of the claw member 14, and which claw leg portions contain the support surfaces 16 and 17, there are provided in each case snap closure means in the form of a respective pin 19 which protrudes out of the related support surface 16 and 17. Each such pin or latching element 19 is exposed to the action of a biasing member, here shown as a related spring 20. The protruding pin members 19 can engage into appropriately configured recesses or depressions 21 provided at the counter surfaces 12*a* of the connection block 12.

The connection block 12 as well as the claw member 14 can be formed of any suitable material, for instance steel or reinforced plastics material.

Both the establishment as well as also the release of the heretofore described connection is extremely simple. To establish the connection, initially the harness 3 containing the overhang or extended portion 18 at the claw member 14 is mounted upon the related connection block 12 and then the connection block 12 and claw member 14 are pressed into one another by carrying out a relative movement or displacement of these parts 12 and 14 towards one another, until the pin members or latching elements 19 latch into the related recesses 21. To release the connection, it is only necessary to insert a tool, for instance a screwdriver or the like, between the connection block 12 and the web 22 of the claw member 14 and then to force both of these parts 12 and 14 away from one another.

The described arrangement is robust and of simple construction, and the relatively large coacting surfaces of the connection block 12 and the claw member 14 ensure for a faultless force transmission.

With sufficient play between the coacting support surfaces of the connection block 12 and the claw member 14 it is additionally possible for the snap closure means to exert a dampening action against oscillations or the like.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A detachable connection arrangement between a harness and a harness lever arrangement of a shed forming device of a loom, comprising:

a lifter means hingedly connected with the harness lever arrangement;

a coupling element supported at an end of said lifter means located at the region of the harness;

a counter coupling element provided at the harness with which form-lockingly engages said coupling element;

said coupling element comprises a connection block having at least two substantially parallel surfaces;

means for supporting said connection block at the lifter means;

said counter coupling element comprising a substantially C-shaped claw member fixedly connected with the harness;

said claw member having inner leg surfaces defining support surfaces for the connection block;

resiliently-biased latching means provided for said claw member; and said resiliently-biased latching means releasably retaining the connection block in the claw member and being effective in a predetermined direction of force application.

2. The connection arrangement as defined in claim 1, wherein:

said connection block has at least a substantially quadratic cross-sectional configuration in its plane of movement.

3. The connection arrangement as defined in claim 1, wherein:

said connection block is structured substantially symmetrically and can be inserted in either of two portions into the claw member by selective rotation of the connection block.

4. The connection arrangement as defined in claim 1, wherein:

said connection block has surfaces coacting with said support surfaces of the claw member;

said surfaces of said connection block being provided with recess means for latching of said latching means therein.

5. The connection arrangement as defined in claim 4, wherein:

said latching means comprises spring-biased pin members.

6. The connection arrangement as defined in claim 4, wherein:

said connection block has a bore for receiving a pin member of said lifter means, defining said connection block-supporting means, for mounting said connection block eccentrically and asymmetrically.

7. The connection arrangement as defined in claim 1, wherein:

one of said support surfaces of said C-shaped claw member comprises an upper support surface defining a protruding portion which extends past the other support surface defining a lower support surface and past said connection block.

* * * * *